US010836068B2

(12) United States Patent
Hurst

(10) Patent No.: US 10,836,068 B2
(45) Date of Patent: Nov. 17, 2020

(54) FEEDER MECHANISM FOR STRINGER NOTCHER

(71) Applicant: Marlin J. Hurst, New Holland, PA (US)

(72) Inventor: Marlin J. Hurst, New Holland, PA (US)

( * ) Notice: Subject to any disclaimer, the term of this patent is extended or adjusted under 35 U.S.C. 154(b) by 238 days.

(21) Appl. No.: 16/003,370

(22) Filed: Jun. 8, 2018

(65) Prior Publication Data

US 2018/0361613 A1 Dec. 20, 2018

Related U.S. Application Data

(60) Provisional application No. 62/522,531, filed on Jun. 20, 2017.

(51) Int. Cl.

| | |
|---|---|
| ***B27F 1/04*** | (2006.01) |
| ***B27F 5/02*** | (2006.01) |
| ***B27C 5/06*** | (2006.01) |

(52) U.S. Cl.

CPC ..... *B27F 1/04* (2013.01); *B27C 5/06* (2013.01); *B27F 5/02* (2013.01)

(58) Field of Classification Search

CPC ..... B27F 1/00; B27F 1/02; B27F 1/04; B27F 1/06; B27F 1/08; B27F 5/00; B27F 5/02; B27C 5/00; B27C 5/06; B65G 59/00; B65G 59/06; B65G 59/062; B65G 59/067; B65G 59/10; B65G 59/101; B65G 59/105; B65G 59/107

USPC ..... 414/797.7, 797.9; 451/333, 335, 337

See application file for complete search history.

(56) References Cited

U.S. PATENT DOCUMENTS 4,132,253 A * 1/1979 Mills ..... B23D 45/102 144/133.1

4,807,678 A * 2/1989 Gray ..... B27C 5/06 144/133.2

* cited by examiner

*Primary Examiner* — Matthew Katcoff

(74) *Attorney, Agent, or Firm* — Miller Law Group, PLLC

(57) ABSTRACT

A rotary feeder mechanism is provided for a stringer notcher wherein the feeder includes opposing pairs of pusher arms with one pusher arm of each pair being located on opposing sides of a magazine holding a vertically stacked supply of stringers to uniformly move the lowermost stringer onto a work table. The opposing pusher arms are eccentrically mounted on opposite sides of a rotary drive shaft. A control link is connected to each pusher arm to maintain the orientation of the distal ends of the pusher arms in a selected orientation during rotational movement. As one pusher arm moves a stringer onto the work table, the next vertically stacked stringer rests on the top surface of the stringer to be eased onto the bottom of the magazine as the pusher arm retracts below the level of the work table for the opposing pusher arm to then engage the next stringer.

17 Claims, 9 Drawing Sheets

FEEDER MECHANISM FOR STRINGER NOTCHER

CROSS-REFERENCE TO RELATED APPLICATIONS

This application claims domestic priority on U.S. Provisional Patent Application Ser. No. 62/522,531, filed on Jun. 20, 2017, the content of which is incorporated herein by reference.

FIELD OF THE INVENTION

This invention relates generally to machines for forming stringers for pallets, and, more particularly, to a board feeder apparatus that feeds boards into the notching machine that forms grooves in the boards to create pallet stringers.

BACKGROUND OF THE INVENTION

Notching machines are utilized primarily in the pallet industry to form notches or grooves in a board that is to become a stringer for the formation of pallets. Stringers are the boards at the bottom of the pallet structure that are notched in two spaced apart locations to permit fork lift tines to be inserted beneath the pallet to enable the pallet and the cargo carried on top of the pallet to be lifted vertically and moved from one location to another.

Notching machines are well known in the pallet industry and include a feed bin into which a supply of properly sized boards is placed. A conveyor lifts the individual boards out of the feed bin to an elevated position and places the individual boards into a vertical magazine to be fed into the notching mechanism. A reciprocating board feeder pushes the individual boards from the bottom of the magazine onto the work table for the notching mechanism. As boards are continually fed onto the feed table, the boards come into engagement with a pair of chippers that form the respective laterally spaced notches into the board.

Speed of operation is an important factor in the purchase of a stringer notching machine. Attempts have been made to make the reciprocating board feeder that moves the bottom-most board in the vertical magazine onto the work table for the notching mechanism. Accordingly, it would be desirable to provide a board feeding mechanism that can be operated in a manner that would speed production of a stringer notching machine.

SUMMARY OF THE INVENTION

It is an object of this invention to overcome the disadvantages of the known prior art by providing a feeder mechanism for a stringer notcher in which the stringers are fed into a notching mechanism with a pair of opposing pusher arms.

It is another object of this invention to provide a feeder mechanism that provides an improved and faster feeding of stringers into engagement with a notching mechanism.

It is a feature of this invention that the pusher arms have rounded ends engagable with the stringers being pushed toward the notching mechanism.

It is another feature of this invention that the opposing pusher arms are mounted for rotation about a drive shaft axis.

It is an advantage of this invention that the rounded ends of the pusher arms maintain engagement of the pusher arms with the stringers as the pusher arms rotate about the drive shaft axis.

It is still another feature of this invention that the feeder mechanism has opposing pusher arms provided in pairs, with one pusher arm of each pair being located on opposing sides of a magazine to move the stringers uniformly from the magazine onto a work table.

It is another advantage of this invention that the opposing pusher arms are mounted on eccentrics on opposite sides of the drive shaft axis.

It is still another advantage of this invention that the opposing pusher arms move stringers from a magazine of stacked stringers in an alternating manner.

It is still another feature of this invention that the move two stringers toward the notching mechanism for each rotation of the drive shaft.

It is yet another feature of this invention that each pusher arm is supported by a control link connected to the pusher arm between the rounded end and the eccentric mounting the pusher arm to the drive shaft.

It is yet another advantage of this invention that the control links operate to keep the rounded ends of the pusher arms from rising with the driven ends as the pusher arms are rotated around the drive shaft.

It is a further feature of this invention that one pusher arm is engaging a stringer in the magazine to start moving the engaged stringer onto a work table toward the notching mechanism while the opposing pusher arm is fully retracting below the level of the work table to move rearwardly as induced by the rotation of the drive shaft.

It is still another feature of this invention that the stringer in the magazine about the stringer being engaged by a pusher arm falls onto the top surface of the pusher arm behind the rounded end.

It is still another advantage of this invention that the movement of the pusher arms after moving a stringer onto the work table toward the notching mechanism is to lower the rounded end of the pusher arm below the level of the work table so that the next stringer in the magazine is eased into position at the bottom of the magazine on the top surface of the pusher arm for the opposing pusher arm to move onto the work table.

It is still another object of this invention to provide a rotary feeder mechanism for moving the lowermost board in a magazine onto a work table for engagement by a notching mechanism.

It is yet another feature of this invention that the rotary feeder mechanism includes a transversely oriented, rotatably driven drive shaft, a drive member secured to the drive shaft to be rotatable therewith, at least two pusher arms pivotally connected to the drive member in a balanced configuration eccentric from the axis of the drive shaft, and a control link pivotally connected to each respective pusher arm to control the orientation of a distal end of the corresponding pusher arm as the pusher arm rotates about the drive shaft on the drive member.

It is a yet another object of this invention to provide a feeder mechanism for use on a stringer notcher to increase the speed of operation of the stringer notcher and which is durable in construction, inexpensive of manufacture, carefree of maintenance, easy to assemble, and simple and effective in use.

These and other objects, features and advantages are accomplished according to the instant invention by providing a rotary feeder mechanism for a stringer notcher in which the feeder mechanism includes opposing pusher arms provided in pairs with one pusher arm of each pair being located on opposing sides of a magazine holding a vertically stacked supply of stringers to uniformly move the lowermost stringer onto a work table toward a notching chipper. The opposing pusher arms are mounted on an eccentric on opposite sides of a rotary drive shaft axis and a control link connected to each of the pusher arms maintains the orientation of the distal ends of the pusher arms in a selected orientation during rotational movement around the drive shaft axis. As one pusher arm moves a stringer onto the work table, the next vertically stacked stringer rests on the top surface of the stringer to be eased onto the bottom of the magazine as the pusher arm retracts below the level of the work table as the opposing pusher arm then engages the next stringer. The distal end of each pusher arm is rounded to keep the end of the pusher arm engaged with the stringer as the driven end rotates about the drive shaft axis.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENTS

Figure 1:
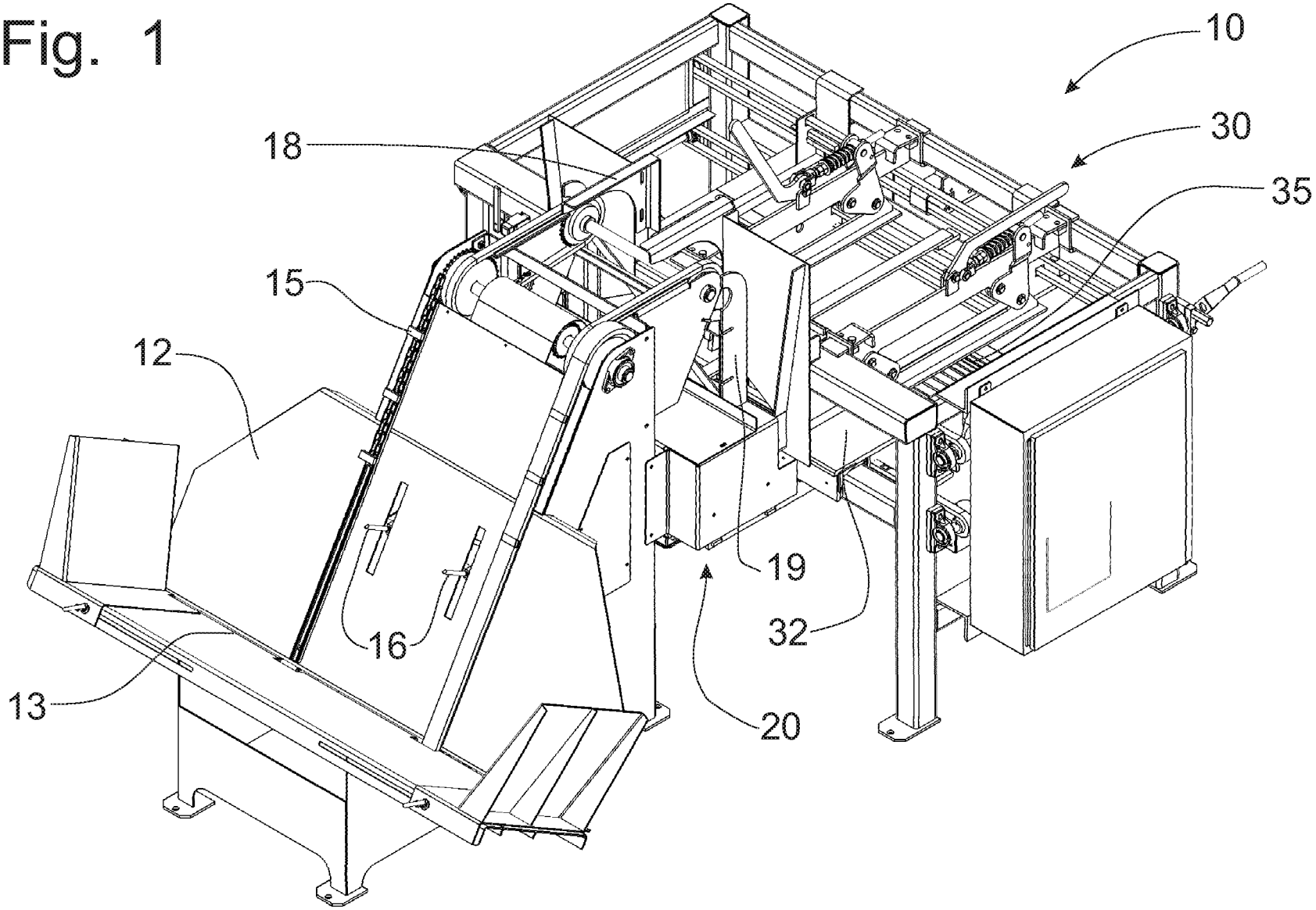
FIG. 1 is a perspective view of a stringer notching machine incorporating the principles of the instant invention.
Figure 2:
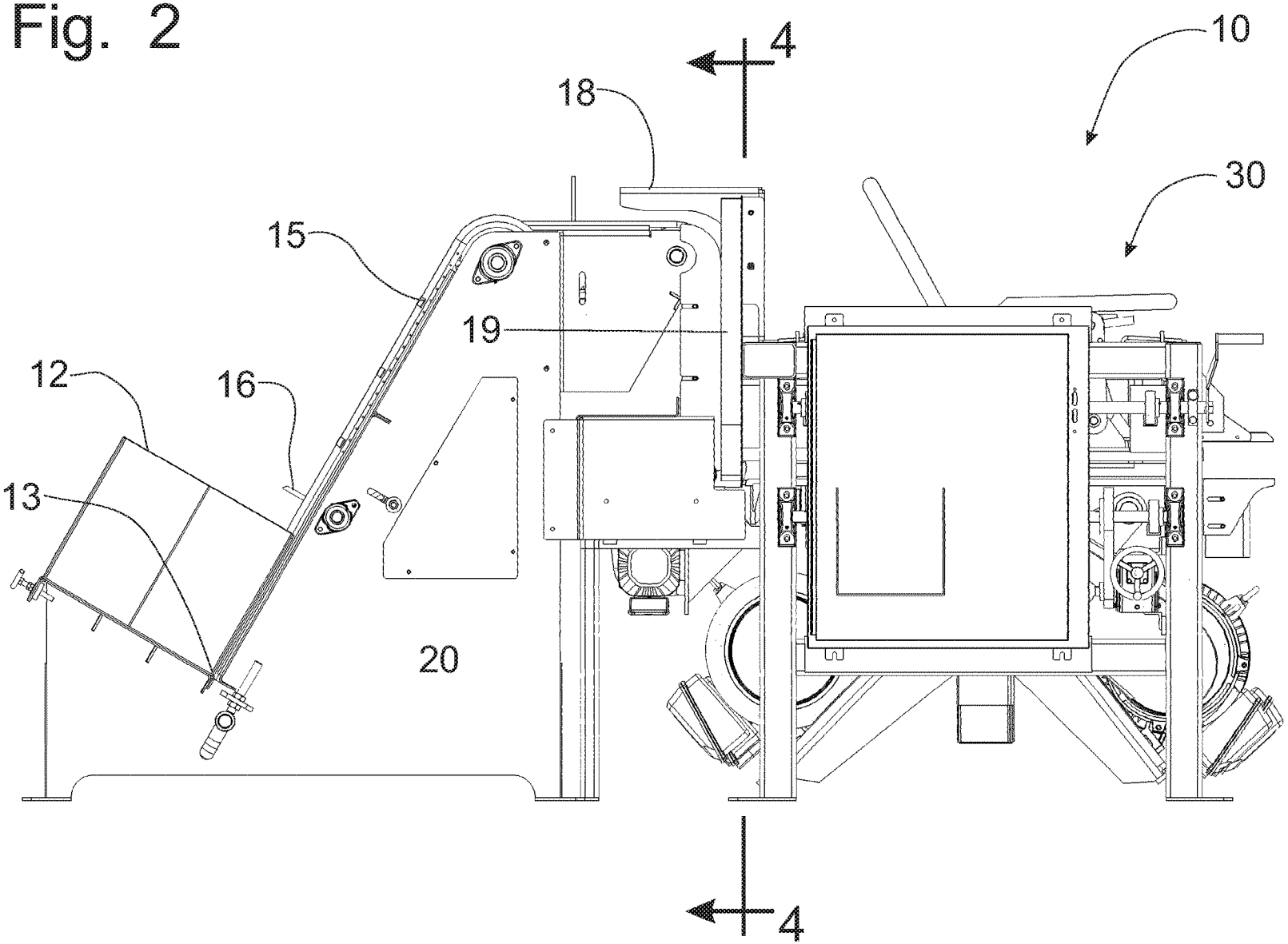
FIG. 2 is a side elevational end view of the stringer notching machine shown in FIG. 1.
Figure 3:
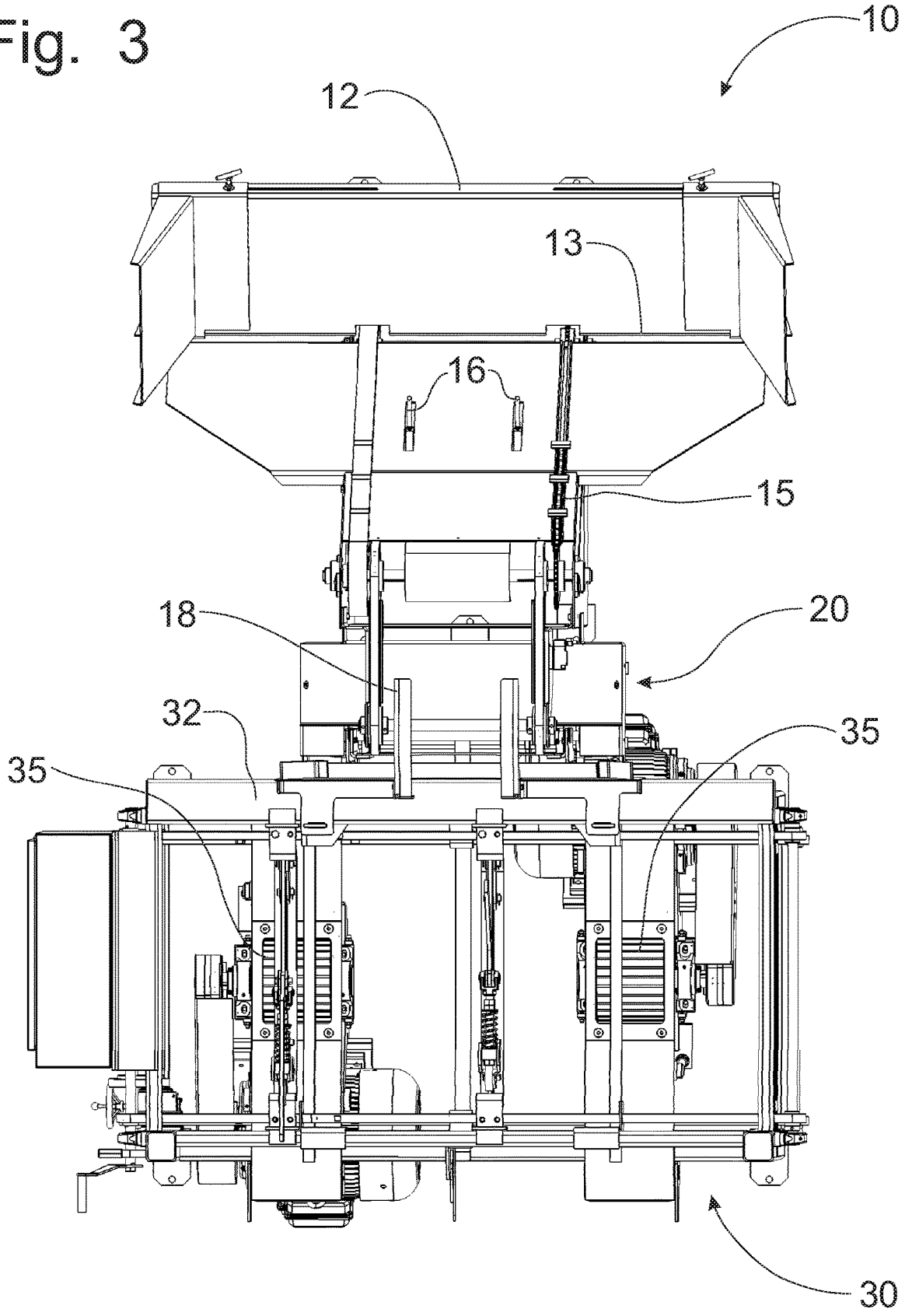
FIG. 3 is a top plan view of the stringer notching machine show in FIG. 1.

Referring now to FIGS. 1-3, a stringer notching machine incorporating the principles of the instant invention can best be seen. The stringer notching machine 10 is an apparatus having a frame 11 supporting an infeed bin 12, a central magazine 19, a board feeding mechanism 20 and a chipping station 30 operable to form notched stringers for the construction of pallets from properly sized boards supplied to the infeed bin 12. The boards supplied to the infeed bin 12 are pre-cut to a predetermined length, width and thickness, whereupon the stringer notching machine 10 is to form a pair of laterally spaced notches, or elongated grooves, into the bottom of each board to permit the insertion of fork lift tines to lift pallets once constructed from the notched stringers.

The infeed bin 12 receives a supply of pre-cut boards from which the stringers are to be formed. Preferably, the infeed bin 12 is oriented with a corner 13 being positioned at the lowermost point of the infeed bin 12 so that the boards placed therein will fall by gravity toward the corner 13. A conveyor 15 engages the boards at the corner 13 of the infeed bin 12 and lifts individual boards upwardly out of the infeed bin 12. A rotatable tine device 16 is engaged and rotated by a board being elevated by the conveyor 15, which causes a second tine to move from below the conveyor 15 and push any extra boards being elevated on the next lug of the conveyor 15 so that each lug carries only one board upwardly toward the magazine 19. One elevated to the top of the magazine 19, baffles or guides 18 cause any misoriented boards to be properly oriented before being conveyed to the top of the magazine 19 and deposited therein.

Once the boards have been fed onto the work table 32 by the feeding mechanism 20 and are pushed by subsequent boards moved from the magazine 19 onto the work table 32, the boards reach the chippers 35 which project upwardly above the work table 32 to engage the boards and chip away the wood corresponding to the two notches to be formed in the bottom portion of the boards. The chippers 35 are driven by large electric motors 36 connected to the chippers 32 by belt drives 38. After the stringers are formed by creating the notches through operation of the chippers 35, the stringers are collected and moved to a remote location.

The boards placed into the magazine 19 will all be oriented in the same manner with a height dimension of the stringer being oriented vertically in the magazine 19 in a single column of boards. The feeder mechanism 20 is positioned behind the magazine 19 to push the bottommost board out of the magazine 19 onto the work table 32 and into the chipping station 30. The feeder mechanism 20 can best be seen in FIGS. 4 and 5. An electric motor 21 (shown in FIGS. 6-12) rotates the drive shaft 23 of the feeder mechanism 20 through a drive belt 22 entrained around a pulley 22*a*. A pair of drive members 24 is mounted in a spaced configuration on the drive shaft 23 to be rotatable therewith. Each drive member 24 is formed with a size adequate to permit the mounting of pusher arms 25, 26 thereto in a manner that is offset from the axis of the drive shaft 23. Alternatively, each pusher arm 25, 26 could be mounted on a separate drive member 24; however, the drive shaft 23 can be better balanced for rotation with one each of the pusher arms 25, 26 mounted on the same drive member 24.

Figure 4:
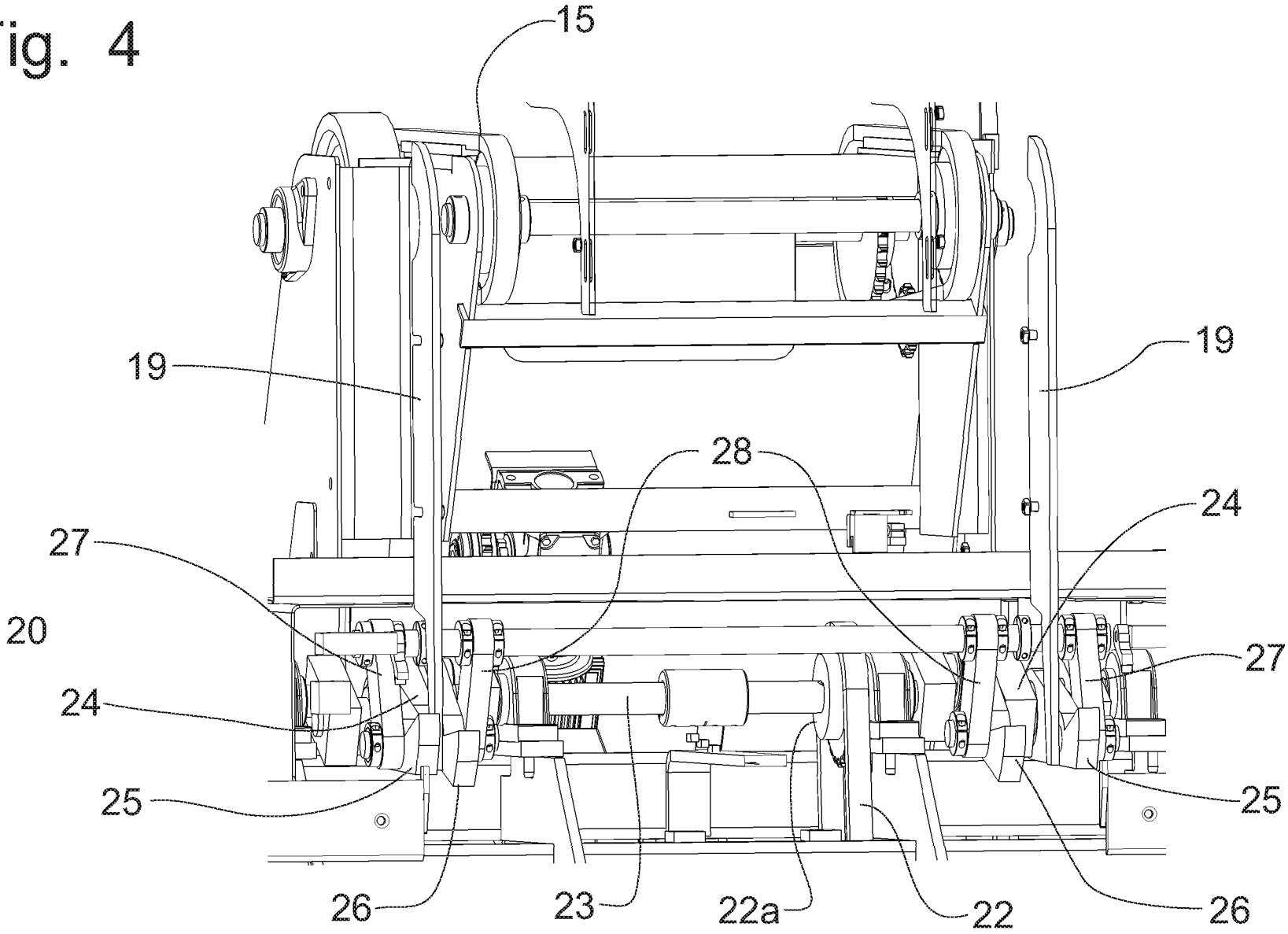
FIG. 4 is a partial perspective cross-sectional view of the feeder mechanism to move boards from the magazine onto the work table of the stringer notching machine corresponding to lines 4-4 of FIG. 2.
Figure 5:
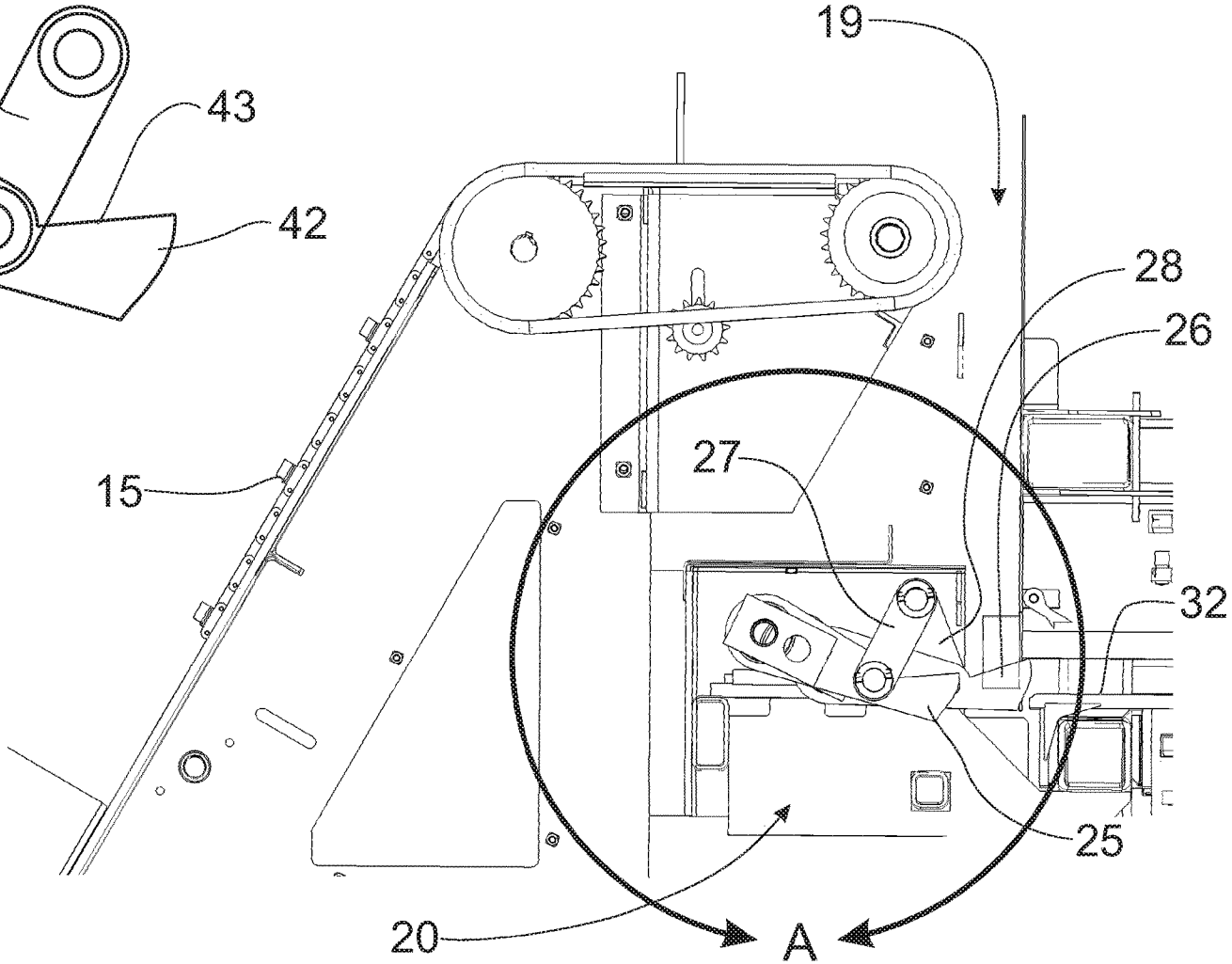
FIG. 5 is a side elevational view of the feeder mechanism for moving boards onto the work table of the stringer notching mechanism shown in FIG. 4.

In the preferred configuration shown in FIGS. 4 and 5, the feeder mechanism 20 is formed with two spaced apart sets of pusher arms 25, 26, each set of pusher arms including a first pusher arm 25, a second pusher arm 26 mounted on the opposite side of a drive member 24 from the first pusher arm 25 with both pusher arms 25, 26 being eccentric to the central drive shaft 23. Each respective pusher arm 25, 26 is also connected to a control link 27, 28 that is pivotally supported on the frame 11 of the stringer notching machine 10 and connected to the respective pusher arm 25, 26 between the mounting of the pusher arm 25, 26 to the drive member 24 and the distal end of the pusher arm 25, 26. The control links 27, 28 controls the attitude of the distal end of the pusher arms 25, 26 as the drive member 24 rotates to cause reciprocation of the pusher arms 25, 26, as will be described in greater detail below.

Figure 5A:
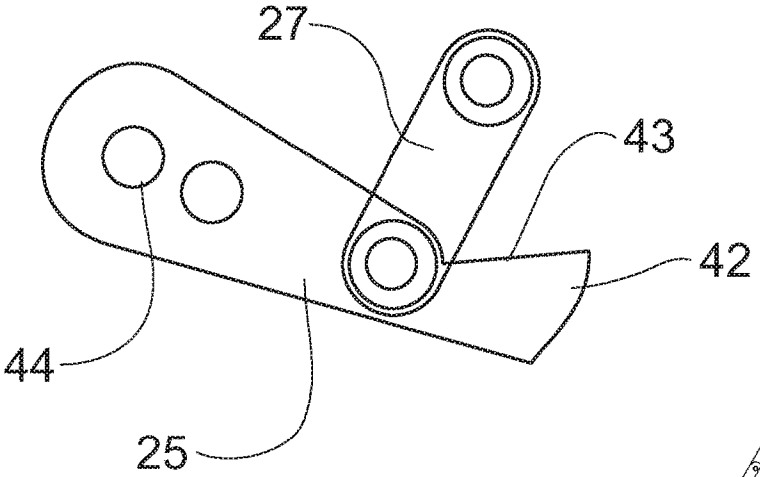
FIG. 5A is a side elevational view of one of the pusher arms forming a part of the feeding mechanism with the corresponding control link depicted.

Referring now to FIG. 5A, each of the pusher arms 25, 26 is formed with a specific shape that facilitates the movement of the boards from the magazine 19 onto the work table 32. The distal end 42 of each pusher arm 25, 26 has a rounded shape to maintain firm engagement with the board being moved from the magazine 19 onto the work table 32 as the pusher arm 25, 26 and drive member 24 are rotated about the axis of the drive shaft 23, as will be described in greater detail below. The top surface 43 of the pusher arms 25, 26 adjacent the distal end 42 is flattened to provide support for the next board in the magazine 19 after the first board is pushed onto the work table 32 and as the pusher arm 25, 26 drops below the surface of the work table 32. The eccentric mounting pivot 44 of the pusher arm 25, 26 for connection to the drive member 24 is depicted in FIG. 5A.

Figure 6:
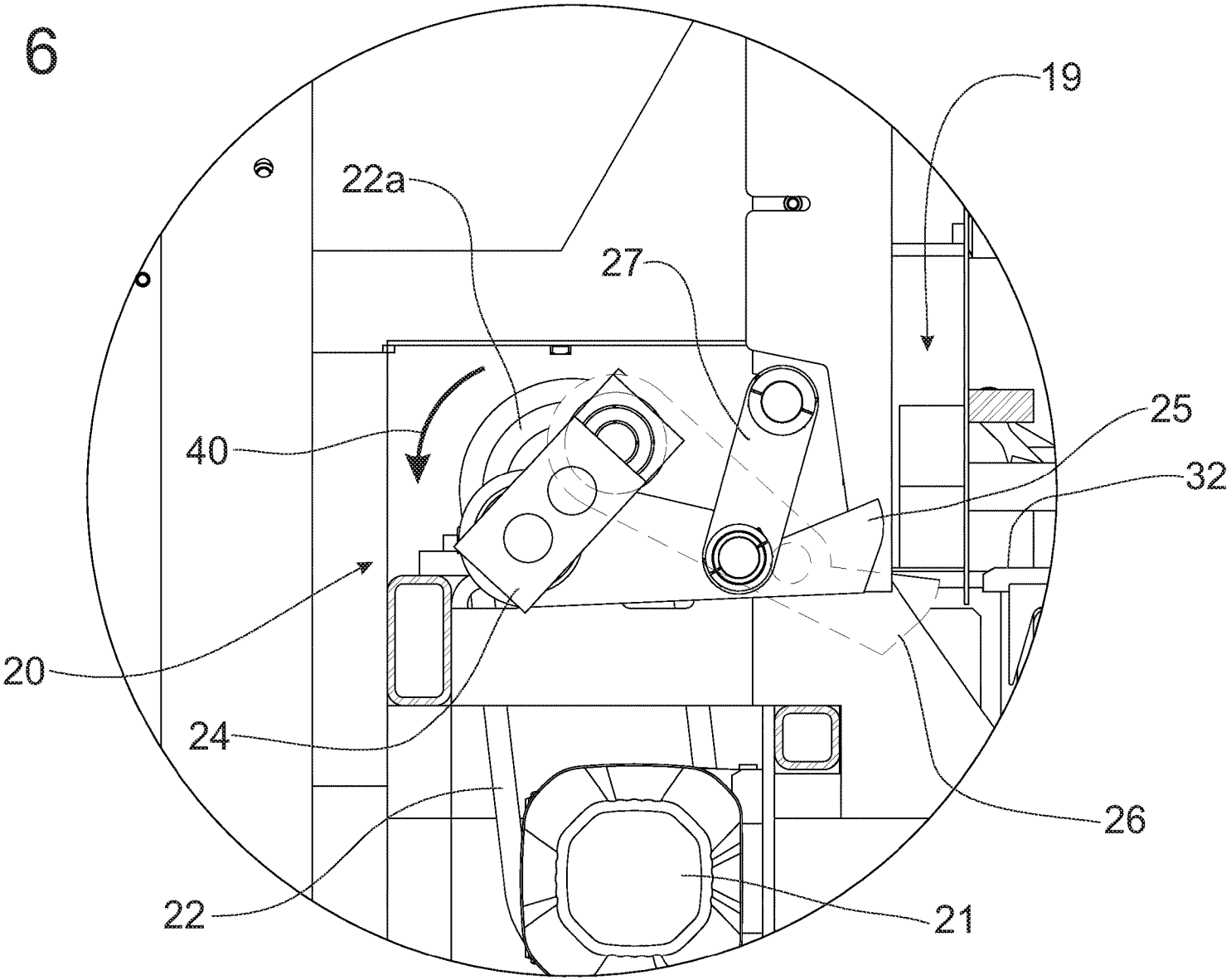
FIG. 6 is an enlarged side elevational view of the feeder mechanism shown in FIG. 5 corresponding to circle-A to depict the movement of the feeder mechanism in moving boards from the magazine onto the work table of the stringer notching machine, the positions of the feeder arms being such that a first feeder arm is moving into engagement with a board at the bottom of the magazine.
Figure 7:
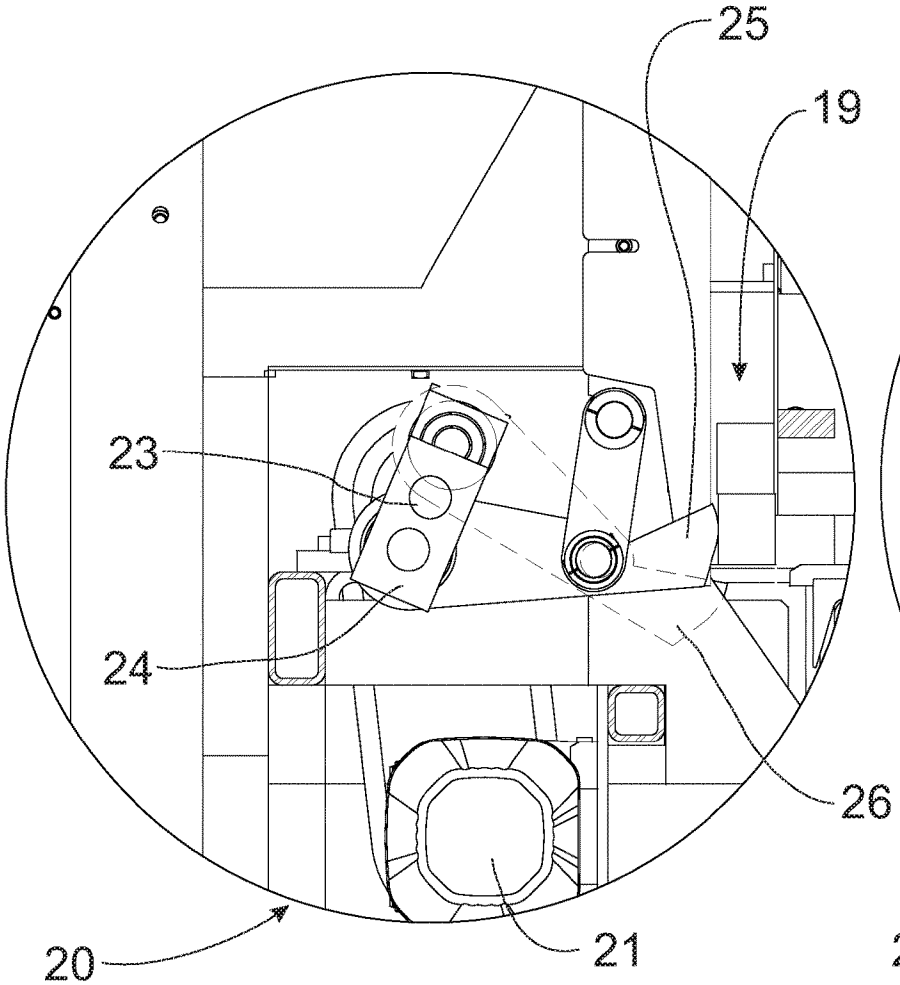
FIG. 7 is an enlarged side elevational view of the feeder mechanism corresponding to circle-A in FIG. 5 with the first feeder arm beginning to push the board from the magazine onto the work table and the second feeder arm retracting away from the magazine.

Referring now to FIGS. 6-12, the operation of the feeder mechanism 20 can be seen. In FIG. 6, the first pusher arm 25 (depicted in solid lines) is being moved forwardly into engagement with the lowermost board in the magazine 19, while the second pusher arm 26 (shown in dashed lines) is located below the surface of the work table 32 and is being retracted away from the magazine 19. The control link 27 for the first pusher arm 25 is shown, but the control link 28 for the second pusher arm 26 is hidden. In FIG. 7, the drive shaft 23 has rotated slightly counterclockwise, as is depicted by the arrow 40 in FIG. 6, from the position shown in FIG. 6 and the first pusher arm 25 has just engaged the lowermost board in the magazine 19 and has started to move the board onto the work table 32. At the same time, the second pusher arm 26 has fully retracted below the level of the work table 32 and is moving rearwardly as a result of the rotation of the drive shaft 23 and the operation of the control link 28 that keeps the distal end of the pusher arm 26 from rising with the driven end of the pusher arm 26 as the pusher arm 26 is rotated around the drive shaft 23.

Figure 8:
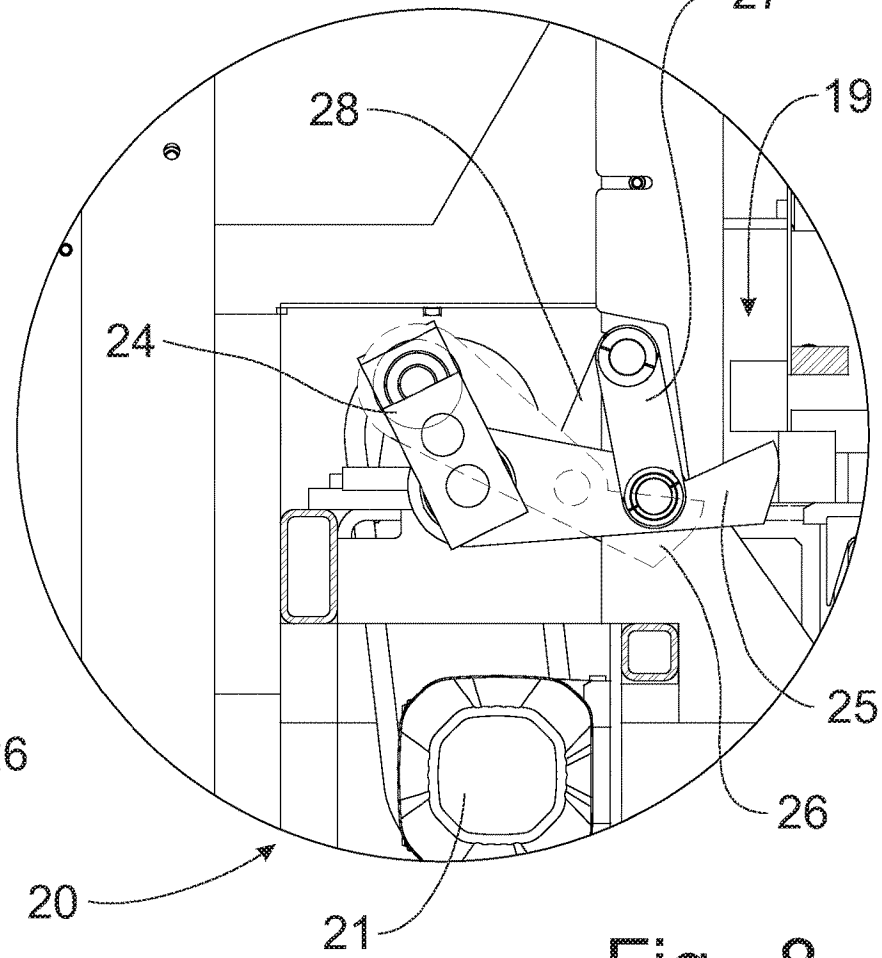
FIG. 8 is an enlarged side elevational view of the feeder mechanism corresponding to circle-A in FIG. 5 with the first feeder arm moving the board from the bottom of the magazine onto the work table.

In FIG. 8, the drive shaft has rotated about thirty degrees or so counterclockwise to push the first pusher arm 25 forwardly and move the lowermost board onto the work table 32. One skilled in the art will not that the bottom of the drive member 24 and the pivotal connection between the control link 27, 28 with the corresponding pusher arm 25, 26 are approximately in the same plane as the work table 32 and, therefore, as the pivotal connection 44 moves along the eccentric arc along the bottom of the drive member 24, the movement of the corresponding pusher arm 25, 26 is substantially horizontal and linear, which causes the pusher arm 25, 26 to move the board onto the work table 32. This continued rotation of the drive member 24 operates to bring the second pusher arm 26 further rearwardly.

Figure 9:
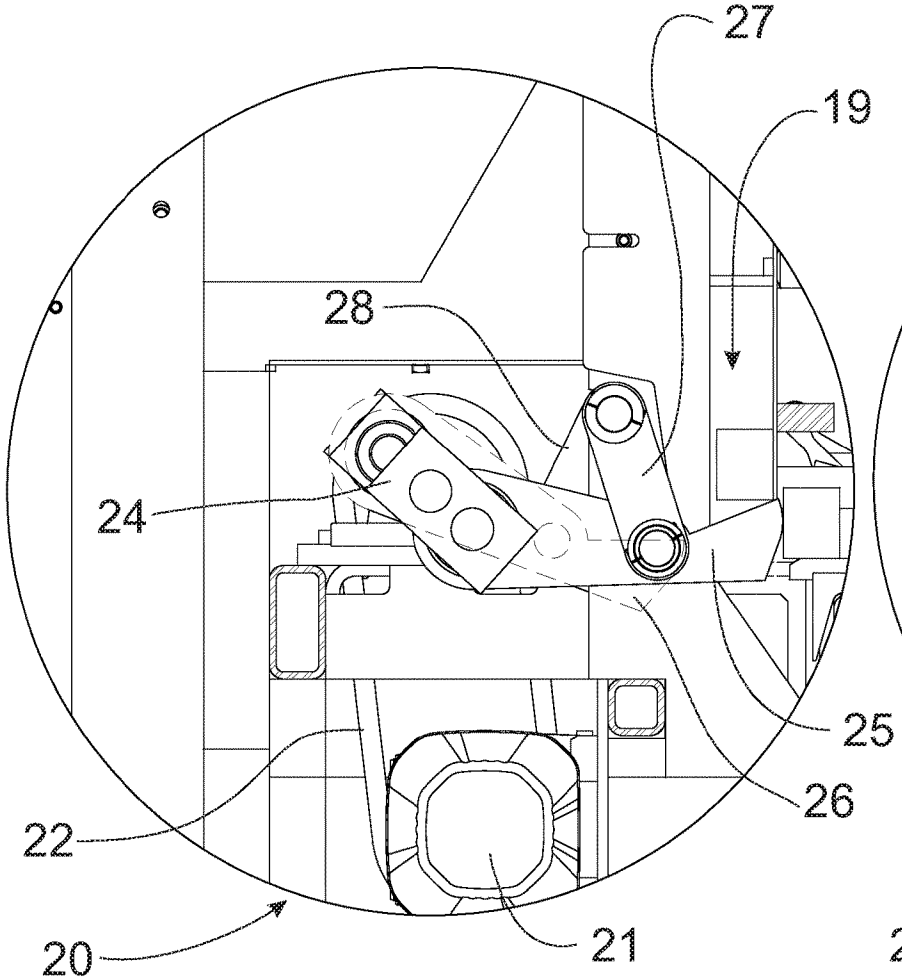
FIG. 9 is an enlarged side elevational view of the feeder mechanism corresponding to circle-A in FIG. 5 with the first feeder arm completing the movement of the board from the bottom of the magazine onto the work table.

In FIG. 9, the drive shaft 23 rotates a slight amount to complete the forward stroke of the first pusher arm 25 and place the lower most board from the magazine 19 fully onto the work table 32. As the board leaves the magazine 19, the next board in the magazine 19 drops onto the top surface 43 of the distal end of the first pusher arm 25. Between FIGS. 9 and 10, the first pusher arm 25 slides rearwardly and drops vertically due to the pivotal connection between the pusher arm 25 and the drive member 24 rising while the control link 27 keeps the distal end of the pusher arm 25 at a lower elevation. This motion of the distal end of the first pusher arm 25 allows the next board within the magazine 19 to be eased down into the bottom of the magazine 19 on the top surface 43 of the first pusher arm 25 until the first pusher arm 25 is fully retracted below the level of the work table 32, as is depicted in FIG. 10.

Figure 10:
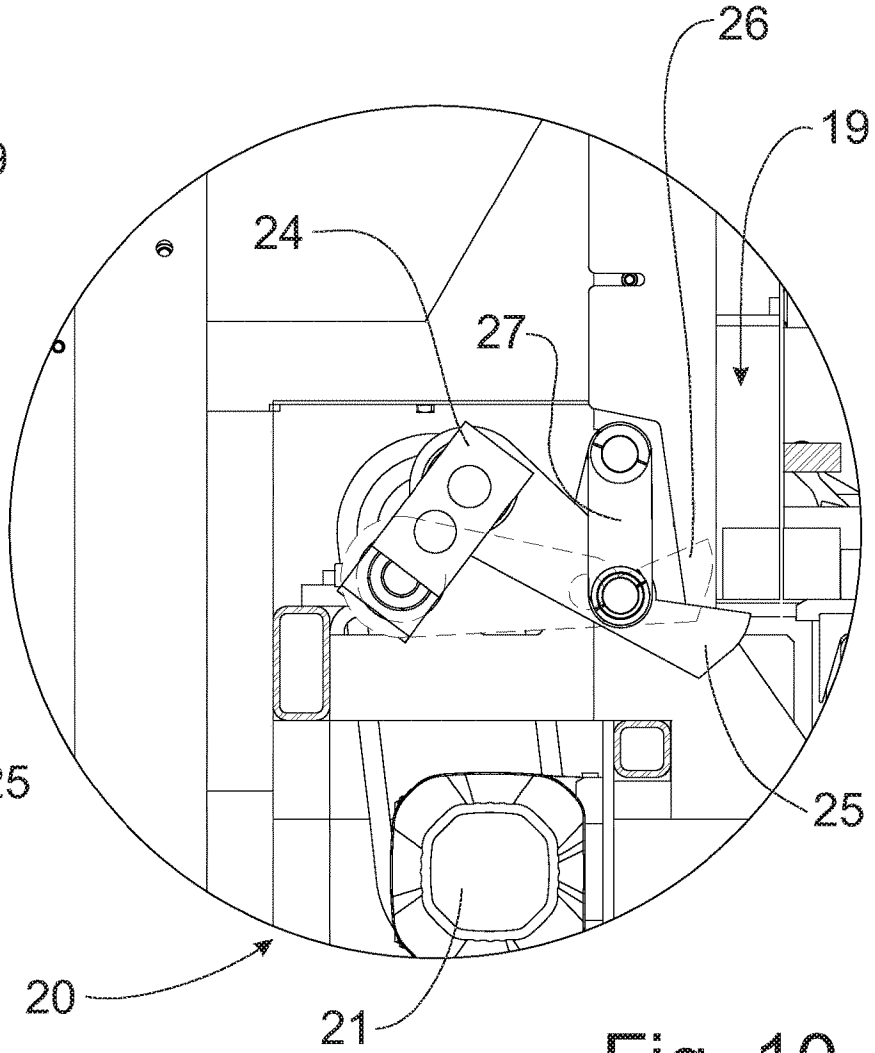
FIG. 10 is an enlarged side elevational view of the feeder mechanism corresponding to circle-A in FIG. 5 with the first feeder arm dropping below the level of the work table to allow the next board in the magazine to lower to the level of the work table, the second feeder arm being in position to engage the next board now at the bottom of the magazine.
Figure 12:
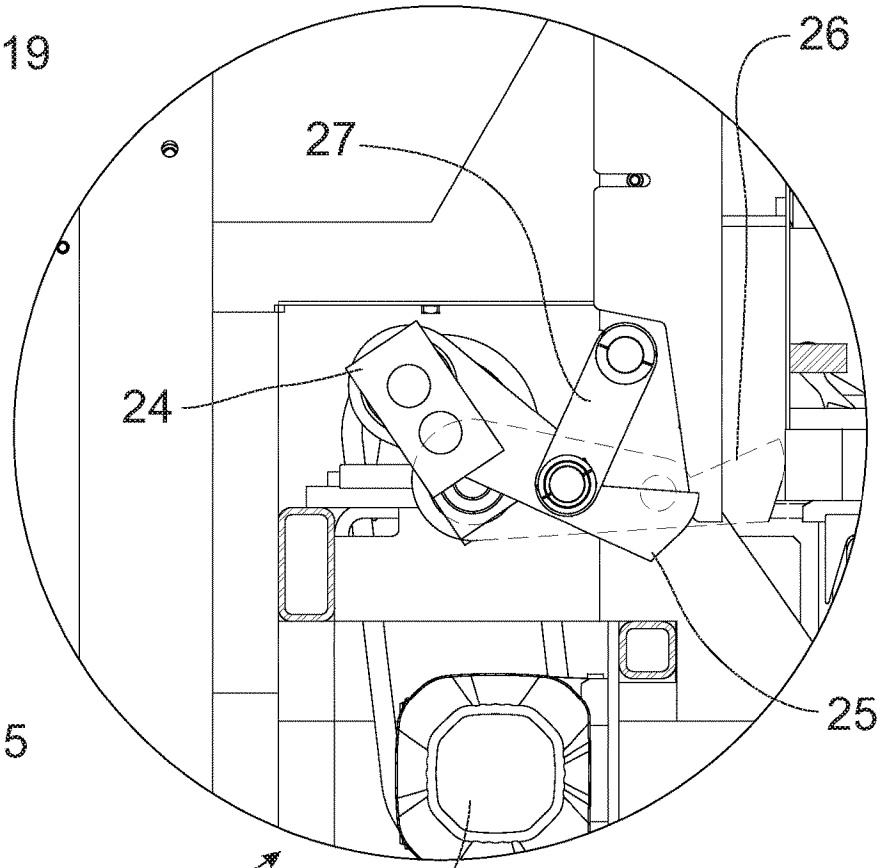
FIG. 12 is an enlarged side elevational view of the feeder mechanism corresponding to circle-A in FIG. 5 with the second feeder arm completing the movement of the next board from the magazine onto the work table and the first feeder arm cycling into position to engage the subsequent board to be dropped into the bottommost position of the magazine.
Figure 11:
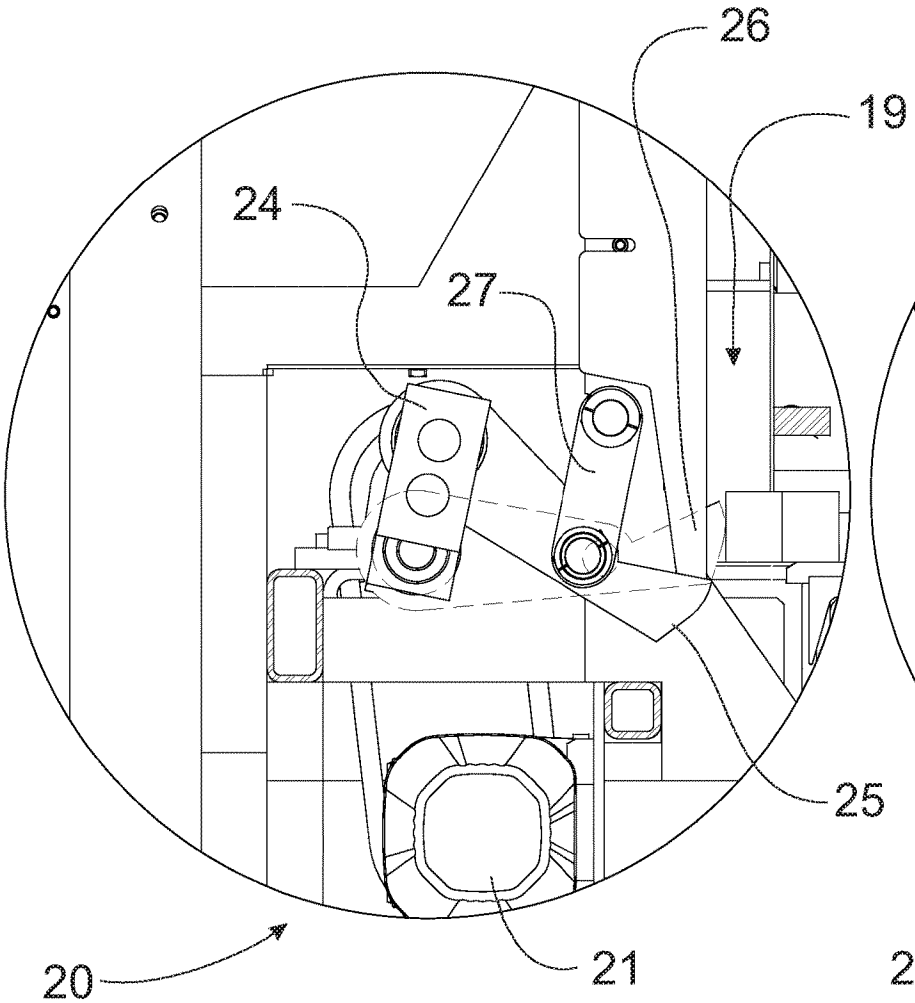
FIG. 11 is an enlarged side elevational view of the feeder mechanism corresponding to circle-A in FIG. 5 with the second feeder arm beginning to push the nest board from the magazine onto the work table to push the first board along the work table.

In FIG. 10, the drive shaft 23 has rotated approximately 180 degrees from the position depicted in FIG. 6, resulting in the first pusher arm 25 being located below the work table 32 and the second pusher arm 26 now being positioned as the first pusher arm 25 was shown in FIG. 6 to engage the now lowermost board in the magazine 19. In FIG. 11, the drive shaft has rotated a few degrees from the position of FIG. 10 so that the second pusher arm 26 now engages the lowermost board in the magazine 19 and starts to push that board against the previous board placed onto the work table 32 by the first pusher arm 25 to advance the boards placed on the work table toward the chippers 35. In FIG. 12, the second pusher arm 26 has now substantially completed its forward stroke to push the board onto the work table 32, as the first pusher arm 25 cycles around to be positioned for engagement with the next board in the magazine that will be lowered by the second pusher arm 26, as described above.

Instead of a linear reciprocating movement of a board pusher as is known in the prior art stringer notchers, the feeding mechanism 20 incorporating the principles of the instant invention can more than double the speed of the operation to feed boards from the magazine 19 onto the work table 32 for engagement with the chippers 35. In addition, the speed of rotation of the drive shaft 23, which reflects directly on the speed at which the boards are moved onto the work table 32, can be varied to conform to the other operations of the stringer notcher. Also, the reciprocating linearly moving board feeders of the known prior art suffer from a greater amount of wear due to the reciprocating action of the apparatus, while the feeder mechanism 20 of the instant invention utilizes a smoothly operating rotational motion to affect the feeding operation.

Although the preferred embodiment of the instant invention utilizes a pair of opposingly mounted pusher arms 25, 26, one skilled in the art will also recognize that more than two pusher arms can be utilized to further increase the operating speed of the feeding mechanism 20. One skilled in the art will recognize that the movement of the pusher arms to drop below the level of the work table 32, so that the next pusher arm can engage the subsequent board from the magazine 19, may require the use of a cam mechanism to control the distal end of the pusher arms in the desired manner as the next pusher arm moves into position to push against the next board from the magazine 19.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A stringer notcher comprising:

an infeed bin for receiving a supply of boards, said infeed bin including a conveyor that engages individual boards from said infeed bin and elevates the engaged board;

a magazine positioned to receive the elevated individual boards from said conveyor and create a column of stacked boards;

a chipping station having at least one chipper rotatably position to form a notch in a bottom side of individual boards;

a work table extending between said magazine and said chipping station to guide a movement of individual boards into engagement with said at least one chipper; and a feeding mechanism for moving said individual boards from said column of stacked boards within said magazine onto said work table, said feeding mechanism including:

a transversely oriented, rotatably driven drive shaft;

a drive apparatus secured to said drive shaft to be rotatable therewith;

a set of at least two pusher arms pivotally connected to said drive apparatus in a balanced configuration eccentric from the axis of said drive shaft, said pusher arms engaging said individual boards in said magazine in a sequential manner with only one pusher arm of said set of pusher arms engaging one of said individual boards at a time; and a set of control links respectively pivotally connected to said set of pusher arms with one of said control links being connected to a corresponding one of said pusher arms to control the orientation of a distal end of the corresponding pusher arm as the pusher arm rotates about the drive shaft on the drive apparatus.

2. The stringer notcher of claim 1 wherein said drive apparatus includes a drive member carrying each pusher arm of said set of pusher arms eccentrically with respect to the axis of said drive shaft on opposing sides thereof.

3. The stringer notcher of claim 2 wherein each said control link causes the corresponding said pusher arm to drop below said work table after said corresponding pusher arm has moved a board from said magazine onto said work table.

4. The stringer notcher of claim 3 wherein each said control link is a fixed length arm pivotally connected to a frame of said stringer notcher at one end and to the corresponding said pusher arm at an opposing end.

5. The stringer notcher of claim 4 wherein each said pusher arm is formed with a top surface that engages a subsequent board in said magazine after said pusher arm has pushed said board onto said work table so that said pusher arm will lower said subsequent board into a lowermost position in said magazine as said pusher arm moves below the work table.

6. In a stringer notcher having an infeed bin for receiving a supply of pre-cut boards from which stringers are made, a conveyor for elevating individual boards from said infeed bin, a magazine for receiving said elevated boards from said conveyor and forming a column of stacked boards, and a chipping station having at least one rotatable chipper for forming a notch into a bottom side of each individual board moving along a work table in said chipping station, the improvement comprising:

a rotary feeder mechanism for moving the lowermost board in said magazine onto said work table for engagement by said at least one chipper, said rotary feeder mechanism including:

a transversely oriented, rotatably driven drive shaft;

a drive apparatus secured to said drive shaft to be rotatable therewith;

a set of at least two pusher arms pivotally connected to said drive apparatus in a balanced configuration eccentric from the axis of said drive shaft and operable to engage the lowermost board in said magazine in an alternating, sequential manner with only one pusher arm of said set of pusher arms engaging one of said individual boards at a time; and a set of control links respectively pivotally connected to said set of pusher arms with one of said control links being connected to a corresponding one of said pusher arms to control the orientation of a distal end of the corresponding pusher arm as the pusher arm rotates about the drive shaft on the drive apparatus.

7. The stringer notcher of claim 6 wherein said rotary feeder mechanism further comprises:

first and second sets of said pusher arms mounted to said drive shaft for rotation eccentrically about said drive shaft, said first and second sets of said pusher arms being positioned in a spaced apart manner along a magazine containing a vertical stack of said pre-cut boards, said first and second sets of said pusher arms being connected by a pair of drive members in said balanced eccentric configuration such that corresponding pusher arms of said first and second sets of pusher arms contact the lowermost board in said magazine simultaneously.

8. The stringer notcher of claim 7 wherein each one of said pair of drive members is connected to one pusher arm of each said set of pusher arms to drive corresponding spaced apart pairs of said pusher arms simultaneously into engagement with said pre-cut boards when in a lowermost position within said magazine to move said boards onto said work table.

9. The stringer notcher of claim 8 wherein each said pusher arm moves substantially horizontally when moving the lowermost board from said magazine onto said work table and then moves vertically downwardly below the work table after the lowermost board has been removed from the magazine to allow a subsequent board to move into the lowermost position in the magazine.

10. The stringer notcher of claim 9 wherein each said control link is a fixed length arm pivotally connected to a frame of said stringer notcher at one end and to the corresponding said pusher arm at an opposing end.

11. The stringer notcher of claim 10 wherein the pivotal connection between each control link and the corresponding pusher arm is in a generally horizontal plane with the pivotal connection of the corresponding pusher arm with the corresponding drive member when said pivotal connection of the corresponding pusher arm has been rotated to a bottom position vertically below the axis of said drive shaft.

12. The feeder mechanism of claim 11 wherein each respective pusher arm is formed with a rounded distal end for engagement with said boards as the pusher arm moves the boards from the magazine onto the work table, and with a flat upper surface to support the subsequent board in the magazine as the pusher arm retracts below the work table.

13. A stringer notcher comprising:

an infeed bin for receiving a supply of boards, said infeed bin including a conveyor that engages individual boards from said infeed bin and elevates the engaged board;

a magazine positioned to receive the elevated individual boards from said conveyor and create a column of stacked boards;

a chipping station having at least one chipper rotatably position to form a notch in a bottom side of individual boards;

a work table extending between said magazine and said chipping station to guide a movement of individual boards into engagement with said at least one chipper; and a feeding mechanism for moving said individual boards from said column of stacked boards within said magazine onto said work table, said feeding mechanism including:

a transversely oriented, rotatably driven drive shaft;

a drive apparatus secured to said drive shaft to be rotatable therewith, said drive apparatus including a drive member carrying each pusher arm of said set of pusher arms eccentrically with respect to the axis of said drive shaft on opposing sides thereof;

a set of at least two pusher arms pivotally connected to said drive apparatus in a balanced configuration eccentric from the axis of said drive shaft for engagement with said individual boards in said magazine; and a set of control links respectively pivotally connected to said set of pusher arms with one of said control links being connected to a corresponding one of said pusher arms to control the orientation of a distal end of the corresponding pusher arm as the pusher arm rotates about the drive shaft on the drive apparatus, each said control link causing the corresponding said pusher arm to drop below said work table after said corresponding pusher arm has moved a board from said magazine onto said work table.

14. The stringer notcher of claim 13 wherein each said pusher arm moves substantially horizontally when moving the lowermost board from said magazine onto said work table and then moves vertically downwardly below the work table after the lowermost board has been removed from the magazine to allow a subsequent board to move into the lowermost position in the magazine.

15. The stringer notcher of claim 14 wherein each said control link is a fixed length arm pivotally connected to a frame of said stringer notcher at one end and to the corresponding said pusher arm at an opposing end.

16. The stringer notcher of claim 15 wherein each said pusher arm is formed with a top surface that engages a subsequent board in said magazine after said pusher arm has pushed said board onto said work table so that said pusher arm will lower said subsequent board into a lowermost position in said magazine as said pusher arm moves below the work table.

17. The stringer notcher of claim 16 wherein the pivotal connection between each control link and the corresponding pusher arm is in a generally horizontal plane with the pivotal connection of the corresponding pusher arm with the corresponding drive member when said pivotal connection of the corresponding pusher arm has been rotated to a bottom position vertically below the axis of said drive shaft.

* * * * *